US008904594B2

(12) United States Patent
Klee et al.

(10) Patent No.: US 8,904,594 B2
(45) Date of Patent: Dec. 9, 2014

(54) AIR CANNON ASSEMBLY HAVING AN AUTOMATED BLAST GUARD VALVE

(75) Inventors: Peter Klee, Espenschied (DE); Oleg Meister, Walluf (DE)

(73) Assignee: Martin Engineering Company, Neponset, IL (US)

( * ) Notice: Subject to any disclaimer, the term of this patent is extended or adjusted under 35 U.S.C. 154(b) by 641 days.

(21) Appl. No.: 13/239,012

(22) Filed: Sep. 21, 2011

(65) Prior Publication Data

US 2013/0068258 A1 Mar. 21, 2013

(51) Int. Cl.

| | |
|---|---|
| ***B08B 5/02*** | (2006.01) |
| ***B08B 9/08*** | (2006.01) |
| ***F27D 25/00*** | (2010.01) |
| ***B08B 9/093*** | (2006.01) |
| ***B08B 1/00*** | (2006.01) |

(52) U.S. Cl.

CPC ..... *B08B 5/02* (2013.01); *F27D 25/008* (2013.01); *B08B 9/093* (2013.01); *B08B 1/005* (2013.01)

USPC ..... 15/405; 222/3; 222/4; 222/195; 222/196; 366/106; 366/107; 134/22.18

(58) Field of Classification Search

CPC ..... B08B 5/02; B08B 9/093; B05B 1/005

USPC ..... 134/22.18; 15/405; 222/3, 4, 195, 196; 366/106, 107

See application file for complete search history.

(56) References Cited

U.S. PATENT DOCUMENTS

| | | | | |
|---|---|---|---|---|
| 5,441,171 | A | 8/1995 | Maury | |
| 6,059,573 | A * | 5/2000 | Patel | 434/16 |
| 2003/0132241 | A1 * | 7/2003 | Treat | 222/4 |
| 2006/0070722 | A1 | 4/2006 | Shelton et al. | |
| 2007/0209648 | A1 * | 9/2007 | Pronschinske et al. | 124/71 |
| 2009/0001097 | A1 * | 1/2009 | Pronschinske et al. | 222/3 |
| 2011/0000936 | A1 * | 1/2011 | Pronschinske et al. | 222/195 |

FOREIGN PATENT DOCUMENTS

| | | |
|---|---|---|
| CN | 2244031 Y | 1/1997 |

* cited by examiner

*Primary Examiner* — Alexander Markoff

(74) *Attorney, Agent, or Firm* — Thompson Coburn LLP; Clyde L. Smith

(57) ABSTRACT

An air cannon has a pressure vessel, a discharge valve, and a discharge tube assembly. The discharge tube assembly comprises a fluid passageway and a blast guard valve. The discharge valve is capable of opening and closing and allows pressurized gas to be discharged from the pressure vessel into the fluid passageway of the discharge tube assembly only when open. The blast guard valve is capable of opening and closing and obstructs the fluid passageway of the discharge tube assembly when closed. The blast guard valve allows gas to pass through the fluid passageway when open. The discharge valve and the blast guard valve are operatively connected to each other in a manner such that the discharge valve can open only when the blast guard valve is open.

3 Claims, 5 Drawing Sheets

AIR CANNON ASSEMBLY HAVING AN AUTOMATED BLAST GUARD VALVE

CROSS-REFERENCE TO RELATED APPLICATIONS

Not Applicable

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention relates generally to air cannons of the type used for removing bulk material deposits from the walls of industrial vessels and other bulk material handling devices, such as kilns used in the cement and paper industries. More particularly, the present invention pertains to an automated blast guard valve, downstream of the air cannon's discharge valve, that opens before each firing of the air cannon and that closes thereafter.

2. General Background

Air cannons are commonly used for removing the buildup of bulk material deposits on the walls of bulk material handling devices, such as kilns and hoppers. An air cannon generally comprises a pressure vessel and a discharge valve. When the discharge valve is actuated, pressurized gas within the pressure vessel escapes therefrom and blasts against the accumulated bulk material, thereby dislodging the accumulated bulk material from surfaces of the bulk material handling device. Although the compressed gas is typically air, other gases such as nitrogen or carbon-dioxide is also sometimes used. Regardless of the composition of the gas, the device itself is commonly and herein referred to as an air cannon.

Periodically, some bulk material handling devices require internal maintenance. When such maintenance occurs, the inadvertent firing of an air cannon can cause potential harm to maintenance workers. As such, some air cannon assemblies incorporate a blast guard valve operatively between the discharge valve of the air cannon and the bulk material handling device to which the air cannon is attached. A blast guard valve allows a maintenance worker to manually obstruct the gas passageway that connects the air cannon to the bulk material handling device. A blast guard valve also prevents bulk material from traveling from the bulk material handling device to the discharge valve of the air cannon during the maintenance of the bulk material handling device. This potentially prevents the bulk material from obstructing the discharge valve when operation of the air cannon resumes. More significantly, when a blast guard valve is closed such that it obstructs the gas passageway, the blast guard valve prevents the pressurized gas from blasting into the bulk material handling if the air cannon's discharge valve inadvertently fires, and thereby provides an additional level of protection for the maintenance workers. When maintenance is complete, the blast guard valves can be reopened so that the normal operation of the air cannons can resume.

The normal operating conditions within a bulk material handling device can be very harsh. For example, kilns can contain very hot bulk material that is also abrasive and corrosive. Unfortunately, the blast guard valves are often exposed to such bulk material during the normal operation of the bulk material handling devices. Over time, this exposure has the tendency to seize or block the blast guard valves in a manner making it difficult or impossible to later close the blast guard valves prior to servicing the bulk material handling devices. As a result, there is a potential that some of blast guard valves will be left open during the maintenance of the bulk material handling devices.

SUMMARY OF THE INVENTION

The present invention reduces the risk that an air cannon will inadvertently fire during the maintenance of a bulk material handling device and also protects the discharge valve of the air cannon during normal operation. Moreover, the present invention significantly reduces the possibility that a blast guard valve will seize open. Unlike prior art blast guard valves, a blast guard valve in accordance with the invention is preferably intermittently opened and closed automatically throughout the normal operation of the air cannon.

In one aspect of the invention, an assembly comprises an air cannon. The air cannon comprises a pressure vessel, a discharge valve, and a discharge tube assembly. The discharge tube assembly comprises a fluid passageway and a blast guard valve. The discharge valve is capable of opening and closing. The discharge valve allows gas having a positive gauge pressure to be discharged from the pressure vessel into the fluid passageway of the discharge tube assembly when the discharge valve is open. The discharge valve prevents gas from being discharged from the pressure vessel into the fluid passageway of the discharge tube assembly when the discharge valve is closed. The blast guard valve is capable of opening and closing and obstructs the fluid passageway of the discharge tube assembly when closed. The blast guard valve allows gas to pass through the fluid passageway when open. The discharge valve and the blast guard valve are operatively connected to each other in a manner such that the discharge valve can open only when the blast guard valve is open.

In another aspect of the invention, an air cannon blast guard assembly comprises first and second gas passageways, and first and second valves. The first and second valve are each capable of opening and closing. The first valve allows gas to pass through the first gas passageway unobstructed by the first valve when the first value is open, and obstructs the first gas passageway when first valve is closed. The second valve allows gas to pass through the second gas passageway when the second valve is open and prevents gas from passing through the second gas passageway when the second valve is closed. The second valve is operatively connected to the first valve in a manner such that the second valve can open only when the first valve is open.

In yet another aspect of the invention, a method of firing an air cannon comprises pressurizing gas within a pressure vessel. The method also comprises actuating a discharge valve by opening a blast guard valve. The actuation of the discharge valve causes a portion of the pressurized gas to escape from the pressure vessel through the discharge valve and through the blast guard valve.

In still another aspect of the invention, a method comprises intermittently firing an air cannon that is connected to a bulk material handling device. The method also comprises intermittently and automatically opening a blast guard valve prior to each of the firings of the air cannon and thereafter closing the blast guard valve prior to the next firing of the cannon.

Further features and advantages of the present invention, as well as the operation of the invention, are described in detail below with reference to the accompanying drawings.

Figure 1:
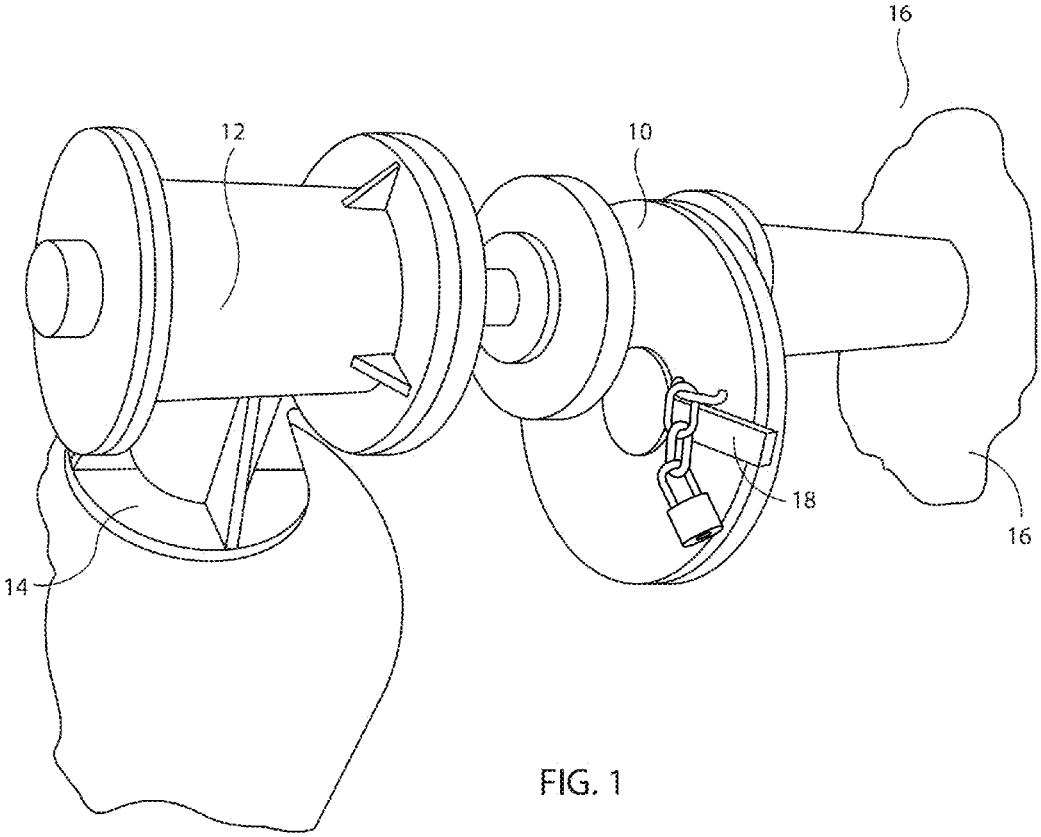
FIG. 1 depicts a prior art air cannon assembly having a manually activated blast guard valve attached to a bulk material handling device.

Reference numerals in the written specification and in the drawing figures indicate corresponding items.

DETAILED DESCRIPTION

A prior art air cannon assembly having a manually activated blast guard valve is shown attached to a bulk material handling device in FIG. 1. The blast guard valve 10 is shown downstream of the discharge valve 12 of the air cannon 14. The blast guard valve 10 is operatively located between the discharge valve 12 and the bulk material handling device 16. The blast guard valve 10 shown in FIG. 1 is operated by manually pivoting the gate of the valve via the exposed lever 18. However, other types of manual valves, such as linear slide gate valves, are also known to have been used as blast guard valves.

Figure 2:
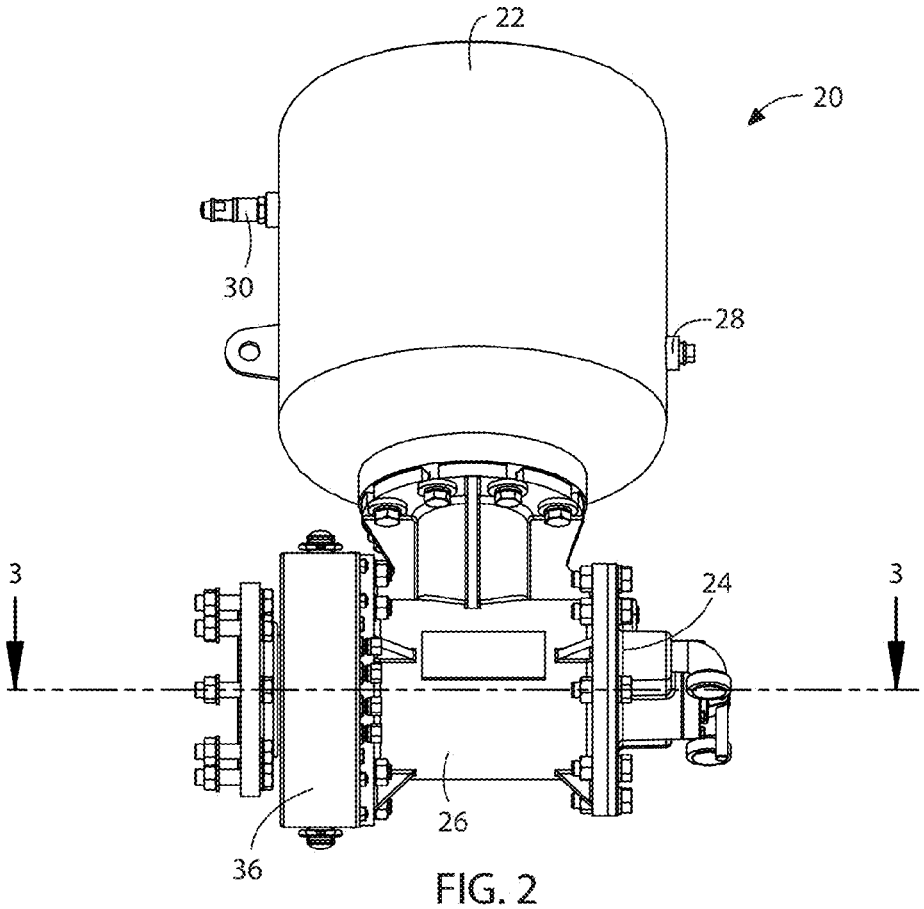
FIG. 2 depicts an air cannon assembly in accordance with the invention.

FIG. 2 depicts an air cannon assembly in accordance with the present invention. The air cannon assembly 20 comprises a pressure vessel 22, a discharge valve 24, and a discharge tube assembly 26.

Figure 3:
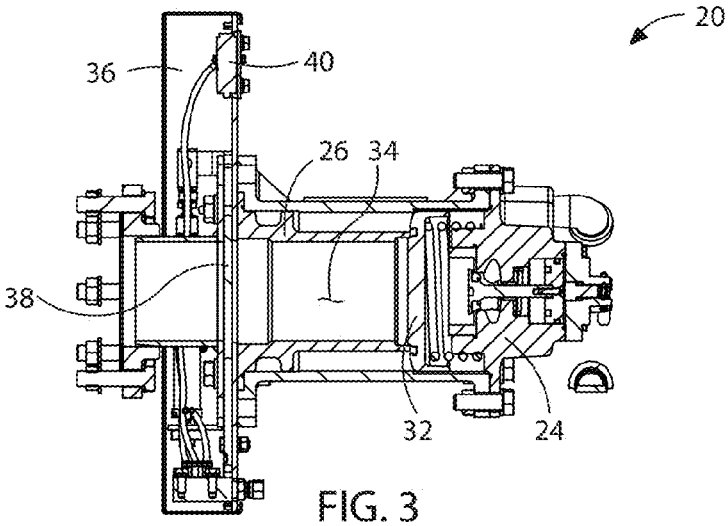
FIG. 3 depicts a cross-section of the air cannon assembly shown in FIG. 2 taken about the line 3-3 of FIG. 2.
Figure 4:
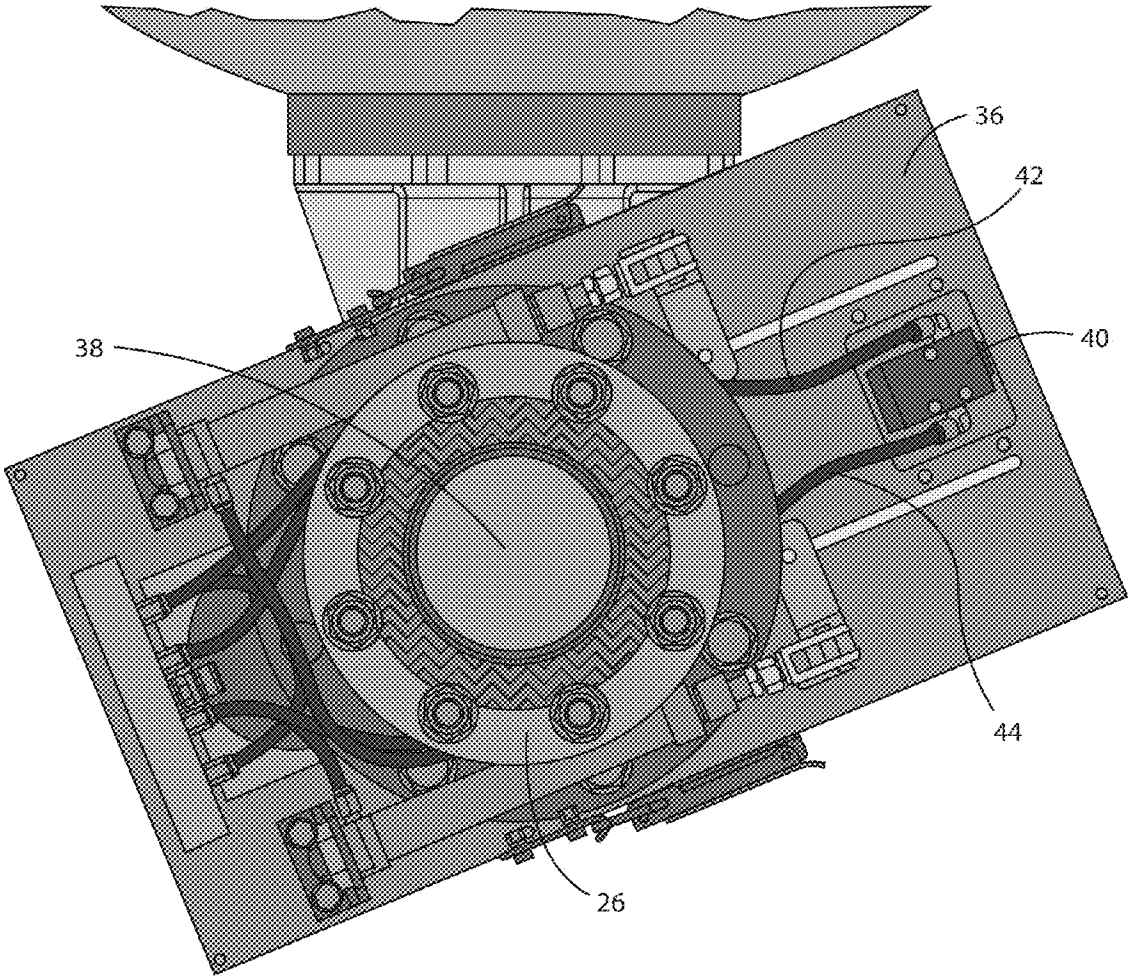
FIG. 4 depicts the internal components of the blast guard valve shown in FIGS. 2 and 3, and is shown with the blast guard valve in its closed configuration.
Figure 5:
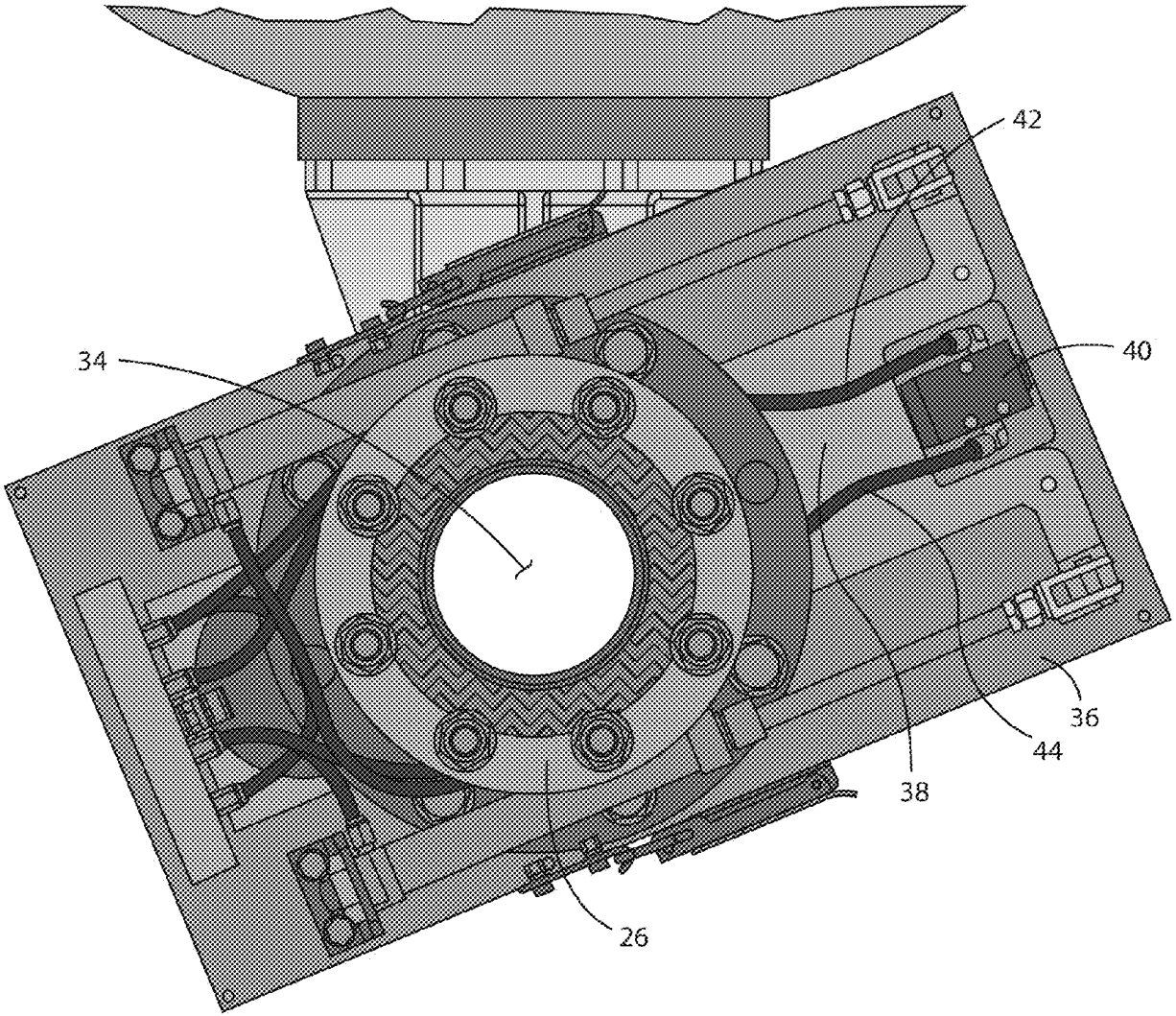
FIG. 5 depicts the internal components of the blast guard valve shown in FIGS. 2 and 3, and is shown with the blast guard valve in its open configuration.

The pressure vessel 22 of the air cannon assembly 20 is configured to store pressurized gas supplied thereto from an external source via a pressurized gas supply port 28. The pressure vessel 22 also comprises a trigger supply port 30 and is operatively connected to the discharge valve 24. The discharge valve 24 comprises a gate 32 (see FIG. 3) that is movable relative to the discharge tube assembly 26. The gate 32 sealably engages the discharge tube assembly 26 when the discharge valve is closed in a manner such that the pressurized gas cannot escape from the pressure vessel 22 into the discharge tube assembly. The discharge valve 24 is preferably pneumatically actuated to open by receiving a signal in the form of pressurized gas.

The discharge tube assembly 26 comprises a fluid passageway 34 and a blast guard valve 36. The fluid passageway 34 extends through the blast guard valve 36. When the discharge valve 24 is open, the gate 32 of the discharge valve sealably disengages the discharge tube assembly 26 and thereby allows a portion of the pressurized gas within the pressure vessel 22 to escape from the pressure vessel 22 into the fluid passageway 34 of the discharge tube assembly. The blast guard valve is openable and closable. The blast guard valve 36 comprises a gate 38 that obstructs the fluid passageway 34 of the discharge tube assembly 26 when closed. The degree to which the gate 38 of the blast guard valve 36 obstructs the fluid passageway 34 is preferably sufficient to prevent a blast of pressurized gas from passing out of the discharge tube assembly 26. However, the gate 38 of the blast guard valve 36 needs not form a pressure-tight seal between the portion of the fluid passageway 34 that is upstream of the gate and the portion of the fluid passageway that is downstream of the gate. When open, the blast guard valve 36 preferably does not obstruct the fluid passageway 34 of the discharge tube assembly 26. The gate 38 of the blast guard valve 36 is preferably pneumatically opened and closed and is preferably a linear slide gate.

The discharge tube assembly 26 also preferably comprises a trigger valve 40 that is mechanically actuated via the gate 38 of blast guard valve 36. Until the gate 38 of the blast guard valve 36 is open, or at least almost completely open, the trigger valve 40 remains closed. When the gate 38 of the blast guard valve 36 is open, or at least almost completely open, the trigger valve 40 is mechanically opened. The trigger valve 40 operatively connects a signal supply fluid passageway 42 to an actuation fluid passageway 44. When open, the trigger valve 40 allows fluid communication between the signal supply fluid passageway 42 and the actuation fluid passageway 44. When closed, the trigger valve 40 prevents fluid communication between the signal supply fluid passageway 42 and the actuation fluid passageway 44. The signal supply fluid passageway 42 is operatively connected to the trigger supply port 30 of the pressure vessel 22 such that, when gas within the pressure vessel is pressurized, so is gas within the signal supply fluid passageway 42. The actuation fluid passageway 44 is operatively connected to the discharge valve 24 in a manner such that the discharge valve is opened when gas within the actuation fluid passageway 44 is pressurized. Thus, when gas within the pressure vessel 22 is pressurized and the trigger valve 40 is opened, the discharge valve 24 is actuated to open.

Figure 6:
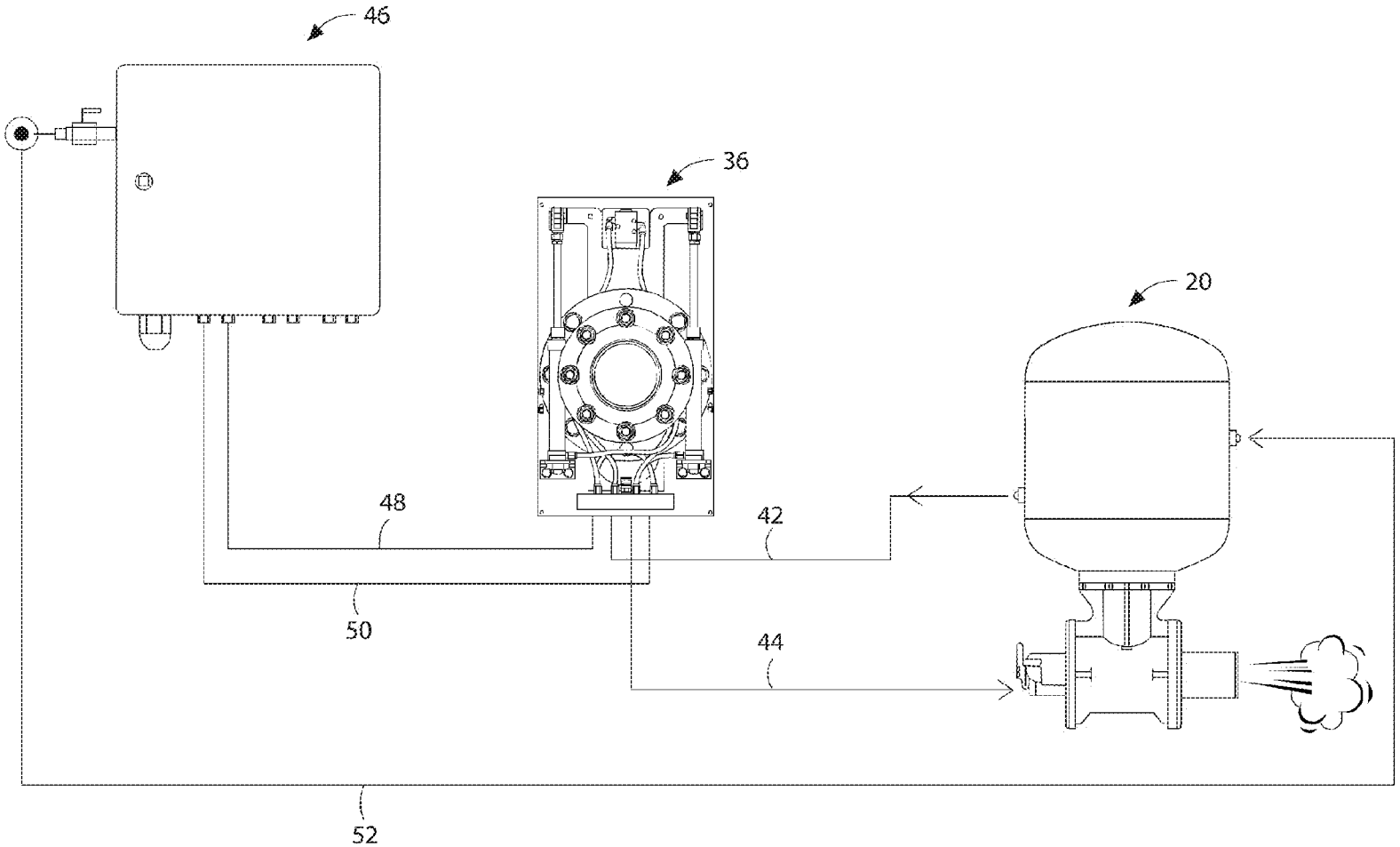
FIG. 6 is schematic for use in describing the operation of the air cannon assembly shown in FIG. 2.

As shown schematically in FIG. 6, the entire assembly is preferably pneumatically controlled via a control unit 46. The control unit 46 is preferably computerized to automatically send pressurized gas through two alternative pneumatic lines. One of the pneumatic lines constitutes a close line 48 that is operatively connected to the blast guard valve 36 in a manner that closes the blast guard valve. The other of the pneumatic lines constitutes an open line 50 that is operatively connected to the blast guard valve 36 in a manner that opens the blast guard valve. Additionally, the control unit 46 preferably provides the pressurized gas supply port 28 of the pressure vessel 22 with a continuous supply of pressurized gas via a pressure vessel supply line 52 (which can be shut off during maintenance of any equipment or for any other reason).

In operation, the pressure vessel 22 is pressurized with gas via the pressure vessel supply line 52. This in turn pressurizes the signal supply passageway 42. Most of the time, the control unit 46 pressurizes the close line 48 to maintain the blast guard valve 36 closed. During such times, the trigger valve 40 remains closed, and therefore the actuation fluid passageway 44 remains unpressurized and discharge valve 24 remains closed. Periodically and for relatively short periods of time, the control unit 46 will depressurize the close line 48 and pressurize the open line 50. This actuates the blast guard valve 36 to open. The opening of the blast guard valve 36 causes the trigger valve 40 to open, which in turn sends a pressure signal to the discharge valve 24, thereby causing the discharge valve 24 to open. Upon the opening of the discharge valve, a portion of the pressurized gas within the pressure vessel 22 blasts out of the pressure vessel and through the fluid passageway 34 of the discharge tube assembly 26. The depressurization of the pressure vessel 22 caused by the blast automatically causes the discharge valve 24 to close, and soon thereafter, the control unit 46 closes the blast guard valve 36. Once the discharge valve 24 has closed, the pressure vessel 22 begins to re-pressurize via the pressurized gas supplied from the pressure vessel supply line 52. Upon re-pressurization, the air cannon assembly 20 is ready to be fired again.

In view of the foregoing, it should be appreciated that the invention achieves the several advantages over the prior art. For example, it should be appreciated that the blast guard valve 36 closes automatically between each firing of the air cannon assembly 20. This helps prevent the blast guard valve 36 from seizing open. Moreover, this helps prevent corrosive or obstructive bulk material from reaching the discharge valve 24 when the air cannon assembly is not being fired. Still further, the present invention insures that the blast guard valve is closed when the air cannon assembly 20 is taken off-line for the maintenance of the bulk material device to which it is attached.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. An assembly comprising:

an air cannon, the air cannon having a pressure vessel, a discharge valve, a trigger valve, and a discharge tube assembly, the discharge tube assembly comprising a fluid passageway and a blast guard valve, the discharge valve being capable of opening and closing, the discharge valve allowing gas having a positive gauge pressure to be discharged from the pressure vessel into the fluid passageway of the discharge tube assembly when the discharge valve is open, the discharge valve preventing gas from being discharged from the pressure vessel into the fluid passageway of the discharge tube assembly when the discharge valve is closed, the blast guard valve being capable of opening and closing, the blast guard valve obstructing the fluid passageway of the discharge tube assembly when closed and allowing gas to pass through the fluid passageway when open, the discharge valve and the blast guard valve being operatively connected to each other in a manner such that the discharge valve can open only when the blast guard valve is open, the discharge valve and the blast guard valve being operatively connected to each other in a manner such that the discharge valve opens in response to the blast guard valve being open, the discharge tube assembly is configured and adapted such that the opening of the blast guard valve causes a signal in the form of gas having a positive gauge pressure to reach the discharge valve, the pressure vessel supplying gas having the positive gauge pressure that forms the signal, and the discharge valve is configured and adapted to open in response to the signal, the trigger valve being operatively connected to the pressure vessel via a first gas passageway and to the discharge valve via a second gas passageway, the trigger valve being capable of opening and closing, the trigger valve operatively connecting the first and second gas passageways when open and operatively disconnecting the first and second gas passageways when closed, the trigger valve being mechanically actuated by the blast guard valve when the blast guard valve is open in a manner causing the trigger valve to open in a manner creating the signal.

2. An assembly in accordance with claim 1 wherein the blast guard valve opens via pneumatic actuation.

3. An assembly in accordance with claim 1 wherein the blast guard valve is a sliding gate valve.

* * * * *